US011633032B2

(12) United States Patent
Bethel

(10) Patent No.: US 11,633,032 B2
(45) Date of Patent: Apr. 25, 2023

(54) LIPSTICK EXTRACTING AND APPLICATION DEVICE

(71) Applicant: Krazy Good Idea, LLC, Orlando, FL (US)

(72) Inventor: Frederick Bethel, Orlando, FL (US)

(73) Assignee: Krazy Good Idea, LLC, Orlando, FL (US)

( * ) Notice: Subject to any disclaimer, the term of this patent is extended or adjusted under 35 U.S.C. 154(b) by 113 days.

(21) Appl. No.: 17/211,194

(22) Filed: Mar. 24, 2021

(65) Prior Publication Data

US 2021/0345756 A1 Nov. 11, 2021

Related U.S. Application Data

(63) Continuation of application No. 29/757,690, filed on Nov. 9, 2020.

(60) Provisional application No. 63/020,606, filed on May 6, 2020.

(51) Int. Cl.

| | |
|---|---|
| ***A45D 40/02*** | (2006.01) |
| ***A45D 40/12*** | (2006.01) |
| *A45D 40/00* | (2006.01) |

(52) U.S. Cl.

CPC ..... *A45D 40/02* (2013.01); *A45D 40/12* (2013.01); *A45D 2040/0062* (2013.01)

(58) Field of Classification Search

CPC ..... A45D 40/02; A45D 40/12; A45D 40/14; A45D 2040/005

See application file for complete search history.

(56) References Cited

U.S. PATENT DOCUMENTS

| | | | |
|---|---|---|---|
| 2,043,250 | A | 6/1936 | Nathan et al. |
| 2,415,306 | A | 2/1947 | Ivor |
| 2,512,476 | A | 6/1950 | Bimkrant et al. |
| 2,552,697 | A | 5/1951 | Tursky |
| 3,728,034 | A | 4/1973 | Winter |
| 3,913,595 | A | 10/1975 | Grisel |
| 3,954,114 | A | 5/1976 | Ostrowsky et al. |
| 4,182,945 | A | 1/1980 | McArdle et al. |
| 4,778,300 | A | 10/1988 | French et al. |
| 4,815,485 | A | 3/1989 | Morel |
| 5,997,202 | A | 12/1999 | Durocher |
| 6,012,863 | A | 1/2000 | Sakurai |
| 6,902,333 | B2 | 6/2005 | Miyagawa et al. |

(Continued)

*Primary Examiner* — Jennifer C Chiang

(74) *Attorney, Agent, or Firm* — Argus Intellectual Enterprise; Jordan Sworen; Daniel Enea

(57) ABSTRACT

A device for extracting lipstick from a lipstick holder and forming a new holder for application of the extracted lipstick. The device includes a housing formed around a sliding barrel movably disposed within a tube. The sliding barrel includes a tab that extends through an aperture of the housing, wherein the tab allows a user to move the sliding barrel between an extended position and a retracted position. The tube has a circumference smaller than a circumference of the lipstick holder, such that an upper end of tube can be circumscribed by the lipstick holder. A remaining portion of lipstick within the lipstick holder is removed by the sliding barrel and received within the housing when the sliding barrel is retracted. A lipstick securing member extends from an upper end of the sliding barrel to assist in the extraction of the lipstick from the lipstick holder.

18 Claims, 8 Drawing Sheets

(56) References Cited

U.S. PATENT DOCUMENTS

| | | | | |
|---|---|---|---|---|
| 9,420,869 | B2 | 8/2016 | Huang et al. | |
| 9,591,908 | B2 | 3/2017 | Kim et al. | |
| 9,781,990 | B2 | 10/2017 | Oh | |
| D818,641 | S | 5/2018 | Wilson et al. | |
| 10,327,532 | B2 | 6/2019 | Li | |
| 2002/0197093 | A1 | 12/2002 | Miyagawa et al. | |
| 2008/0041747 | A1 | 2/2008 | Mihara et al. | |
| 2010/0054842 | A1* | 3/2010 | DeVito ..... | A45D 40/026 401/109 |
| 2011/0123249 | A1 | 5/2011 | Delbove et al. | |
| 2014/0219703 | A1 | 8/2014 | Kim | |
| 2021/0393019 | A1* | 12/2021 | Rome ..... | A45D 40/02 |

* cited by examiner

LIPSTICK EXTRACTING AND APPLICATION DEVICE

CROSS REFERENCE TO RELATED APPLICATION

This application claims the benefit of U.S. Provisional Application No. 63/020,606 filed on May 6, 2020 and U.S. Design Application No 29/757,690 filed on Nov. 9, 2020. The above identified patent applications are herein incorporated by reference in their entirety.

BACKGROUND OF THE INVENTION

The present invention relates to a lipstick extractor. The lipstick extracting and application device comprises housing disposed around a sliding barrel and tube configured to remove unused or inaccessible lipstick from a lipstick holder, wherein the housing is used to form a new lipstick holder for application.

Lipstick is a common makeup tool used to add color to and accentuate the lips. This cosmetic product is a malleable stick, easily susceptible to damage. It is often sold in a plastic or metal case with a twistable portion that exposes or conceals more of the product depending upon the direction it is twisted. This allows for the product to be protected when concealed in the case but applied when the product is exposed from the case. However, this structure often results in a portion of the product being unused. When the lipstick is fitted into the case, a portion of the product is connected to the base at the bottom of the case. The twisting of the case elevates this base to expose more product. As the consumer uses most of the lipstick, the base approaches the top of the case. Once the base reaches the top, all the useable product is gone while the portion of the product in the base is incapable of being applied, thus resulting in loss of product.

To maximize the useable product in these commonly purchased lipsticks, a device is necessary to extract the inaccessible product from the lipstick holder. Some known devices serve to extract chunks of the unused lipstick portion. However, once extracted there is no housing for the lipstick or way of applying the lipstick without the use of a finger.

Therefore, there exists a need for a device that comprises a tube having a circumference smaller than a circumference of the lipstick holder, such that an upper end of the sliding barrel is circumscribed by the lipstick holder and a remaining portion of lipstick within the lipstick holder is removed by a sliding barrel and received within a housing.

In light of the devices disclosed in the known art, it is submitted that the present invention substantially diverges in design elements and methods from the known art and consequently it is clear that there is a need in the art for an improvement for a lipstick extracting and application device. In this regard the instant invention substantially fulfills these needs.

SUMMARY OF THE INVENTION

In view of the foregoing disadvantages inherent in the known types of lipstick extracting devices now present in the known art, the present invention provides a new lipstick extracting and application device wherein the same can be utilized for conveniently and neatly removing unused portion of a lipstick from a lipstick holder and housing the remaining portion of lipstick, so it is ready for application.

It is an objective of the present invention to provide a lipstick extracting and application device comprising a housing formed around a sliding barrel movably disposed within a tube, wherein the sliding barrel comprises a tab extending perpendicularly from a lower end thereof. The sliding barrel assembly is configured to extend within a lipstick holder and remove a remaining portion of lipstick.

It is another objective of the present invention to provide a lipstick extracting and application device wherein the housing comprises a base, an open upper end, and a sidewall extending therebetween. The tab of the sliding barrel is disposed through the aperture in a sidewall of the housing and movable between an extended position and a retracted position.

It is yet another objective of the present invention to provide a lipstick extracting and application device comprising a flange that extends around a perimeter of the upper end of the housing configured to receive and secure to a cap, wherein the cap removable covers the extracted, unused portion of the lipstick so it is ready for application.

It is therefore an object of the present invention to provide a new and improved lipstick extracting and application device that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for extracting and forming for application the unused portions of lipstick from a lipstick holder. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment", "first embodiment", "second embodiment", or "third embodiment" does not necessarily refer to the same embodiment.

Figure 1:
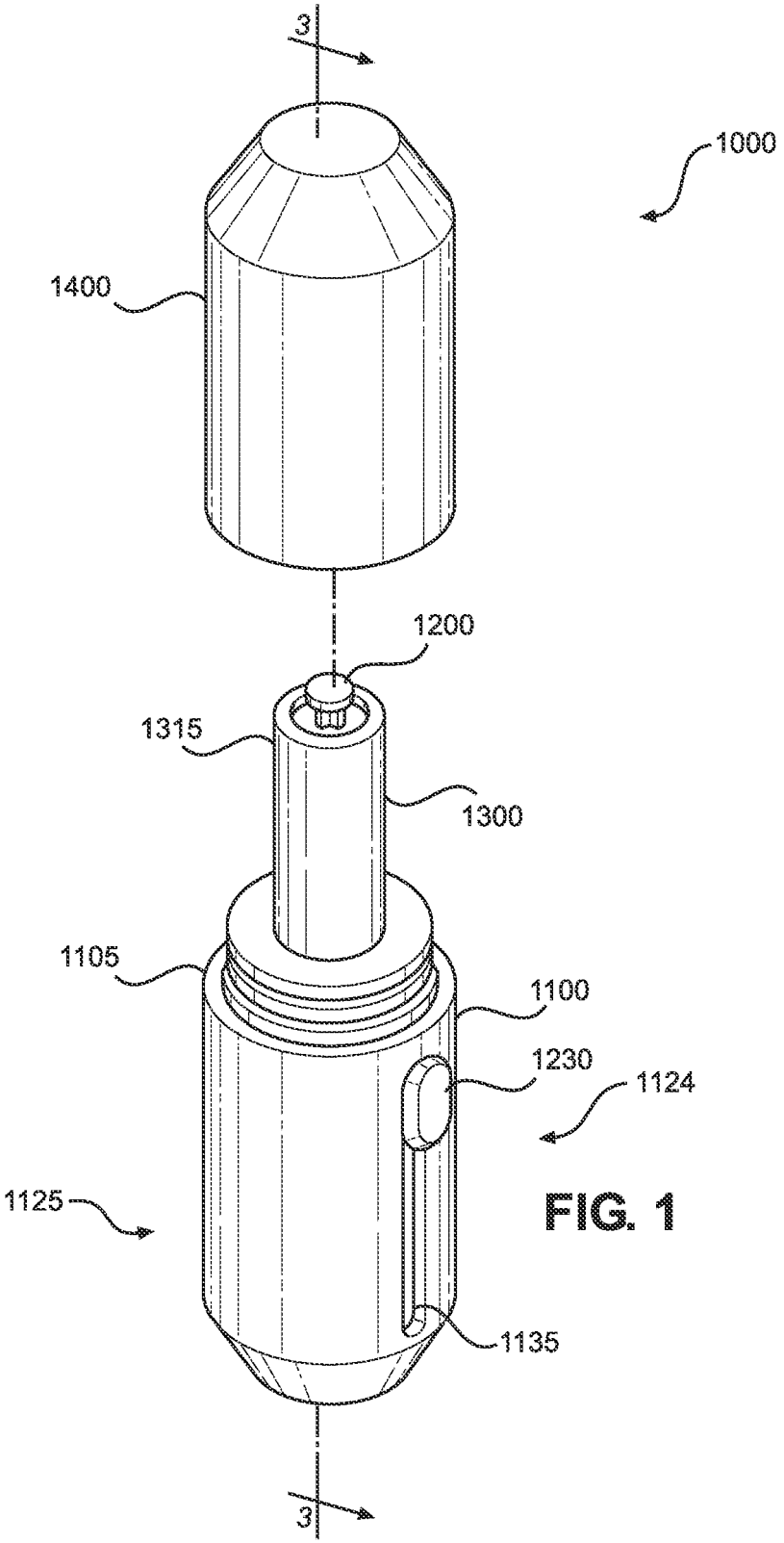
FIG. 1 shows a perspective view of an embodiment of lipstick extracting and application device with the cap separated from the housing.

Referring now to FIG. 1, there is shown a perspective view of an embodiment of the lipstick extracting and application device. The lipstick extracting and application device 1000 comprises a housing 1100 having a front side 1124 and a rear side 1125 formed around a sliding barrel 1200 movably disposed within a tube 1300. The sliding barrel 1200 and tube 1300 are configured to extract a remaining portion or otherwise unusable portion of lipstick from an existing lipstick holder. The device stores the extracted lipstick within the housing 1100 for reuse and application to the lips of a user. In this way, lipstick from an existing lipstick holder will not be wasted due to being inaccessible or damaged within an existing lipstick tube.

An upper end of the housing 1100 comprises an exterior shoulder 1105 extending around a perimeter of the housing 1100 configured to receive and secure to a cap 1400. The cap 1400 is adapted to removably cover the upper end of the tube and preserve the extracted lipstick within the housing 1100. In the illustrated embodiment, the cap 1400 secures to the housing 1100 via an interlocking joint shown FIG. 3. In some embodiments, the exterior shoulder 1105 comprises a fastener configured to mate with a fastener disposed on an interior of the cap. In other embodiments, the cap 1400 friction fits around the exterior shoulder, requiring force from a user to separate the cap 1400 from the housing 1100. In some embodiments, the cap 1400 is transparent to allow a user to see the lipstick color stored within the housing.

Figure 2:
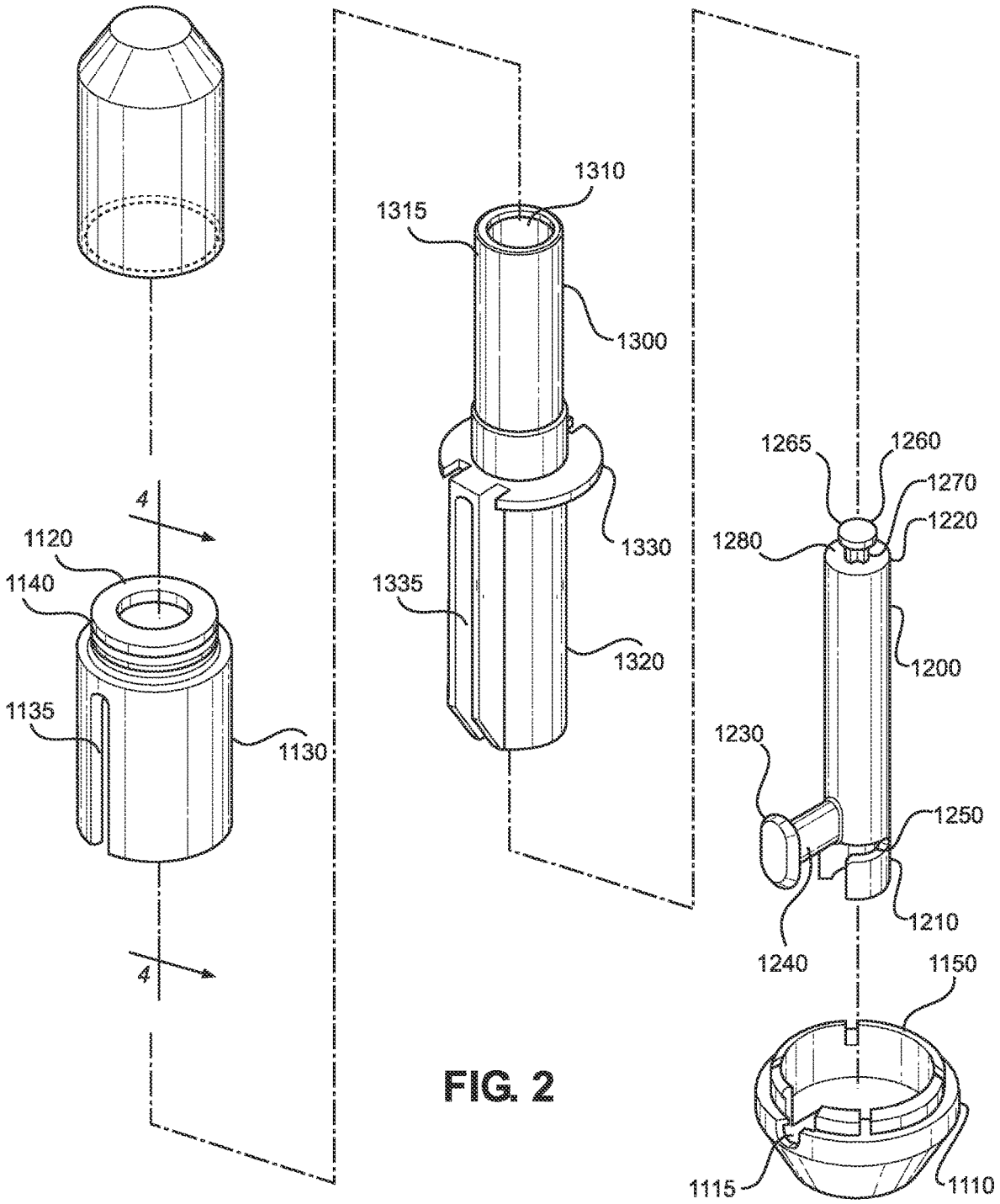
FIG. 2 shows an exploded view of an embodiment of the lipstick extracting and application device.
Figure 3:
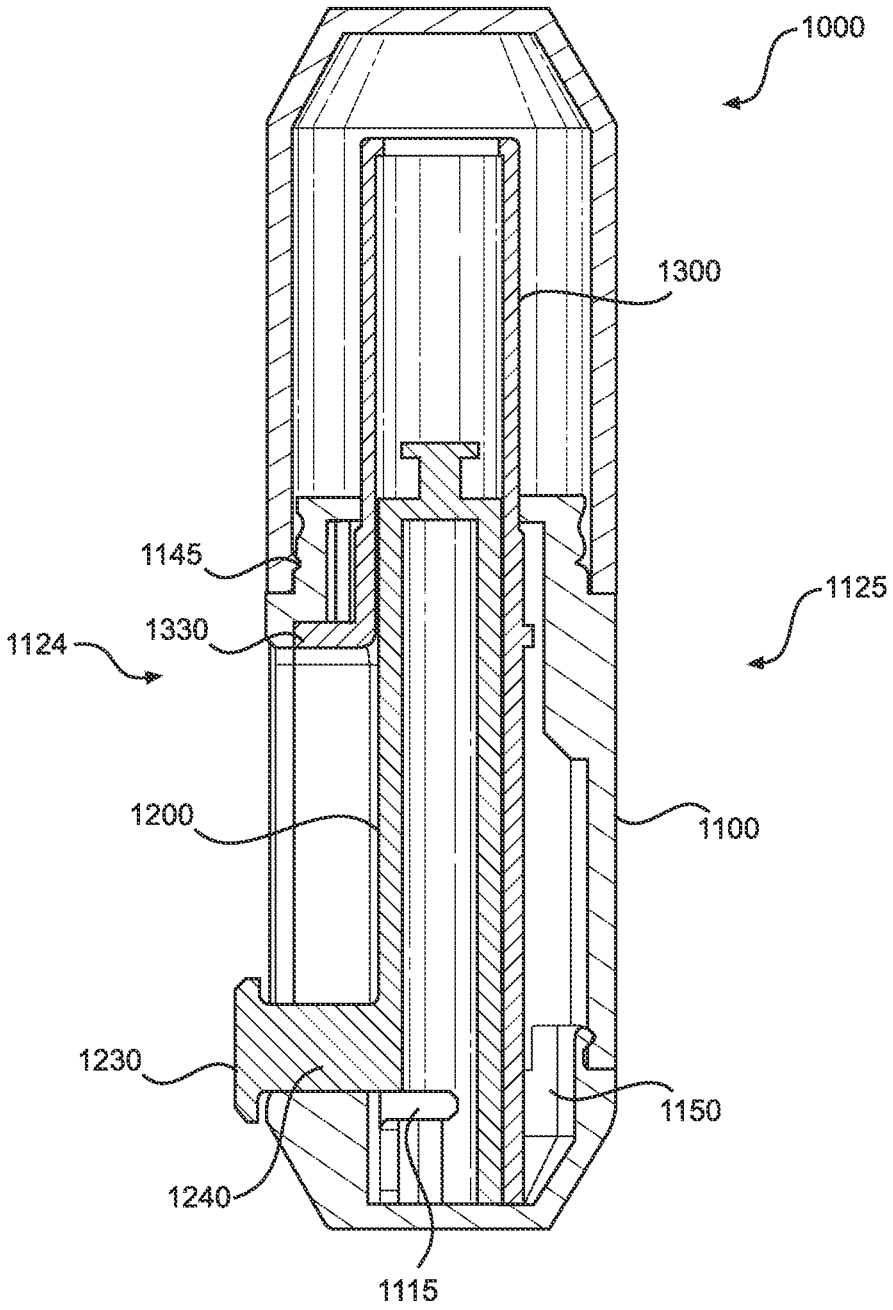
FIG. 3 shows a cross sectional view of an embodiment of the lipstick extracting and application device taken along line 3-3 of FIG. 1.

Referring now to FIGS. 2 and 3, there is shown an exploded view and a cross sectional view of an embodiment of the lipstick extracting and application device, respectively. The sliding barrel 1200 is slidably disposed within the tube 1300 and is movable between an extended configuration and a retracted configuration. In the illustrated embodiment, the sliding barrel 1200 is cylindrical in shape and comprises a circumference configured to fit within the tube 1300. The sliding barrel 1200 comprises a lower end 1210 and an upper end, wherein a tab 1230 extends perpendicularly from the lower end. The tab 1230 extends through a sidewall channel 1135 of the housing 1100 and a sidewall channel 1335 of the tube 1300, wherein the sidewall channels 1135, 1335 are aligned with one another to simultaneously receive the tab 1230 therethrough. The tab 1230 is configured to allow a user to move the sliding barrel 1200 between the extended and retracted configurations. The sidewall channels 1135, 1335 extends through a majority of a length of the side of the housing 1100 and tube 1300, respectively, and serves as a boundary for the movement of the sliding barrel 1200.

Figure 6:
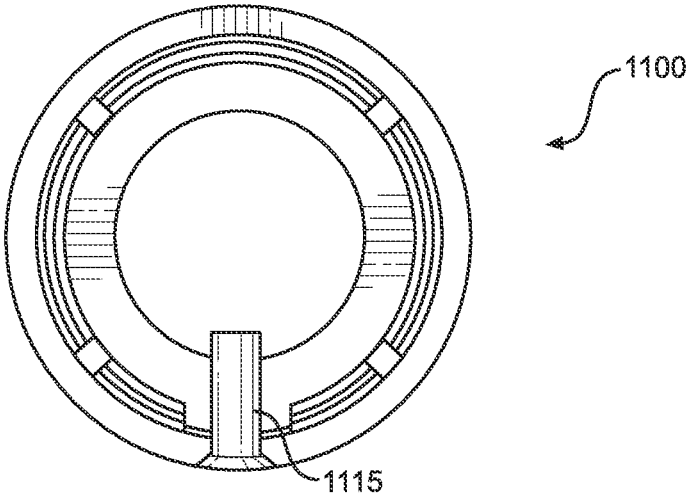
FIG. 6 shows a top elevation view of a base of a housing of the lipstick extracting and application device.

The tab 1230 comprises a neck 1240 that is supported by a base 1110 of the housing 1100 when the sliding barrel 1200 is in the retracted configuration. The neck 1240 permits the tab 1230 to extend through each of the sidewall channels 1135, 1335. In the illustrated embodiment, also shown in FIG. 6, the base 1110 of the housing 1100 comprises a cradle 1115 extending inward from a front side 1124 configured to receive and support a lower end of the neck 1240 in the retracted configuration. The cradle 1115 extends into a slot 1250 disposed along a horizontal plane of the sliding barrel 1200.

In the illustrated embodiment, the sliding barrel 1200 comprises an upper end 1220 having a lipstick securing member 1260 configured to remove the lipstick from the lipstick holder. In the illustrated embodiment, the lipstick securing member 1260 is disposed at an uppermost surface 1280 of the sliding barrel 1200 and comprises a planar disc 1265 elevated from the upper most surface 1280 by a support member 1270. The planar disc 1265 comprises a diameter smaller than a diameter of a sidewall of the sliding barrel 1200 in order to allow the lipstick to pass between the disc 1265 and the interior sidewall of the tube when transitioning between the retracted and extended configuration. In the illustrated embodiment, the support member 1270 comprises an x-shaped cross section, wherein the support member 1270 does not extend beyond the boundary of the outer perimeter of the disc.

Figure 4:
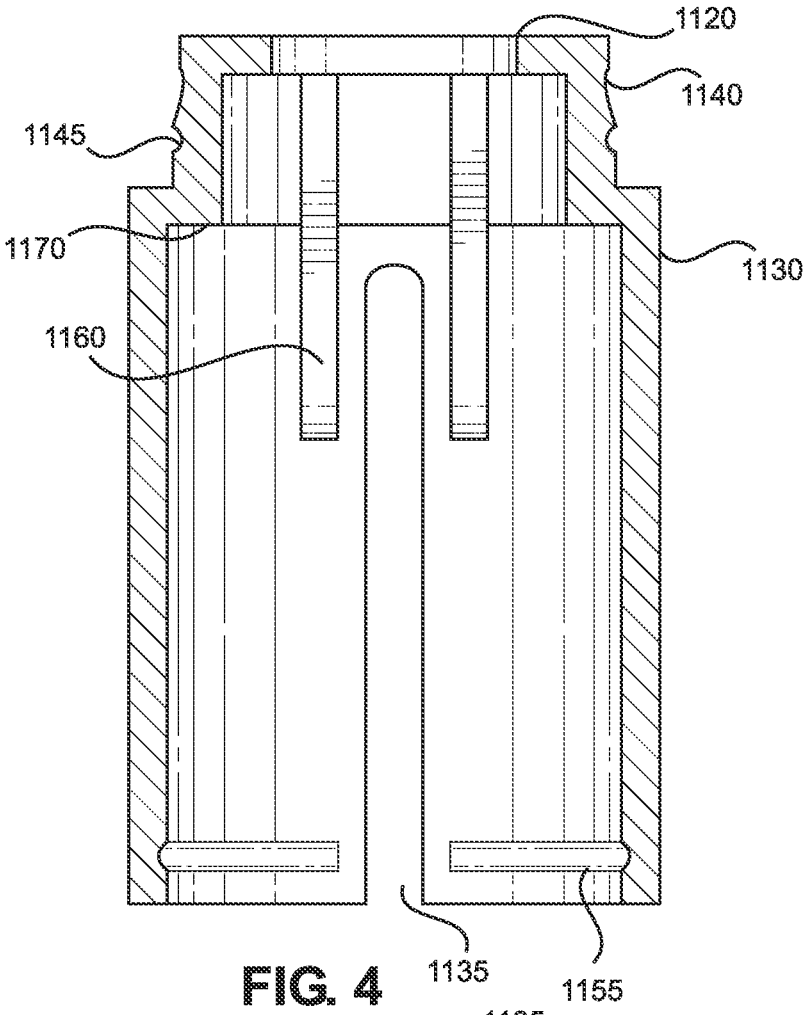
FIG. 4 shows a cross sectional view of an upper end of a housing of the lipstick extracting and application device.
Figure 5:
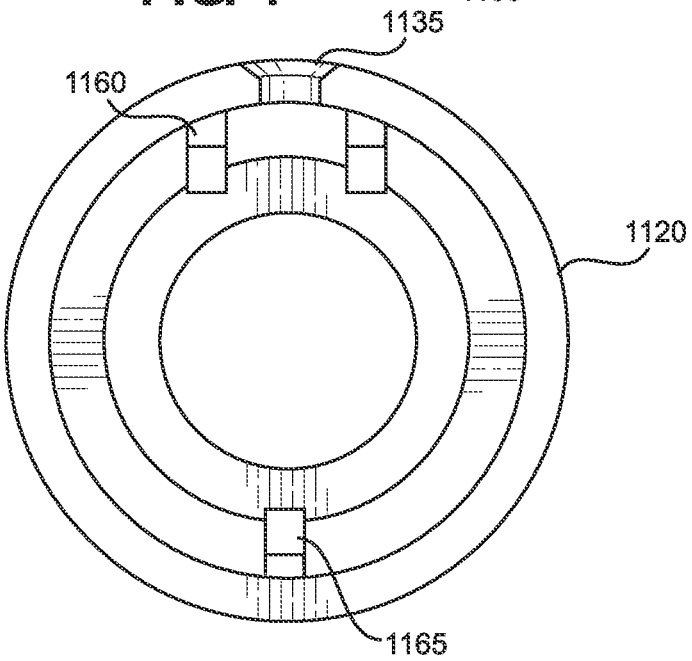
FIG. 5 shows a bottom elevation view of an upper end of a housing of the lipstick extracting and application device.

Referring now to FIGS. 2, and 4-5, there is shown the exploded view of the lipstick extracting and application device, a cross sectional view of an upper end of a housing, and a bottom elevation view of an upper end of a housing, respectively. The housing 1100 comprises the base 1110, an upper end 1120, and a sidewall 1130 extending therebetween. The upper end 1120 comprises an opening to receive the upper end of the tube 1300 therethrough and, in the illustrated embodiment, a cap fastening sidewall 1140 disposed above the exterior shoulder 1105 of the housing. The cap fastening sidewall 1140 comprises a diameter smaller than a diameter of the housing sidewall 1130 to fit entirely within the cap and secure the cap thereto. A groove 1145 is disposed around the cap fastening sidewall 1140 configured to removably receive a protrusion disposed on an interior side of the cap such that when the cap is resting on the exterior shoulder 1105 the groove 1145 receives the protrusion, thereby securing the cap thereto.

In the illustrated embodiment, the upper end 1120 of the housing 1100 is separable from the base 1110 of the housing via interlocking joints 1150, 1155. In some embodiments, the housing comprises a first side removably securable to a second side via a pair of interlocking joints or fastening arms. However, in alternate embodiments, each side of the housing is securable to one another via any suitable fastener. In other embodiments, the housing is a unitary or monolithic structure formed around the sliding barrel and tube. The base 1110 of the housing forms the lowermost end of the lipstick extracting and application device 1000, wherein the base 1110 is flat and configured to support the device 1000 in an upright configuration.

In the illustrated embodiment, the upper end of the housing 1100 comprises a pair of front rails 1160 disposed at a front side of the housing and a rear rail 1165 disposed at a rear side of the housing. The rails extend vertically along an interior of the housing 1100 and configured to engage with the tube 1300 to prevent rotation movement therewith. The sidewall channel 1135 of the housing 1100 is disposed between the pair of front rails 1160 and the rear rail 1165 is disposed directly across from the sidewall channel 1135. The rails extend from the upper end of the housing and partially along the sidewall 1130 thereof, such that the rails do not extend to the base or the interlocking joint 1155.

Figure 7:
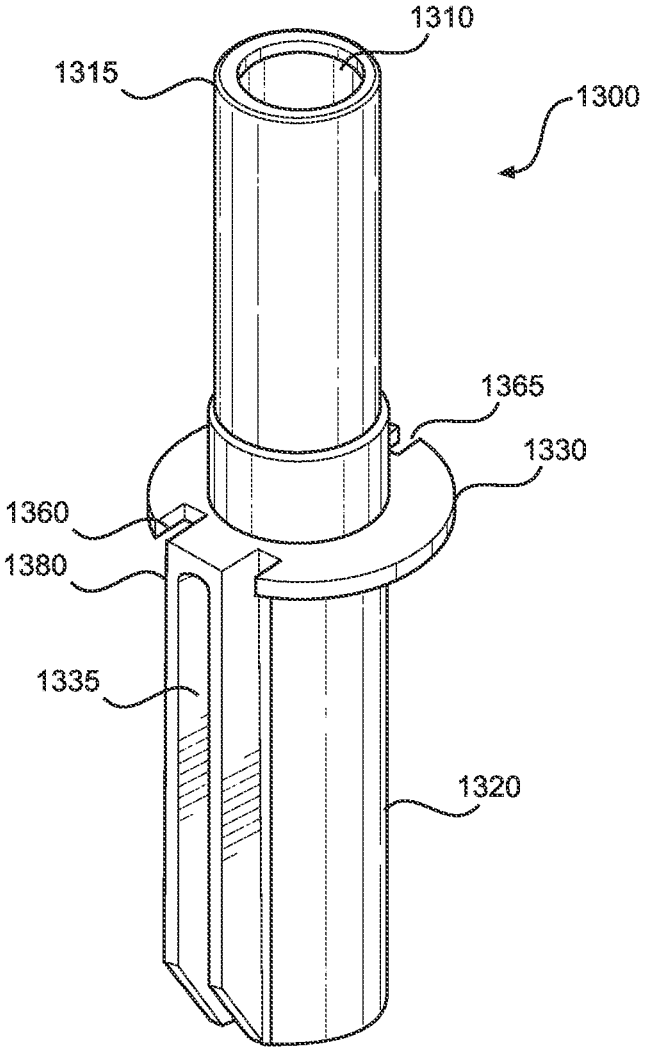
FIG. 7 shows a perspective view of the tube of the lipstick extracting and application device.
Figure 8:
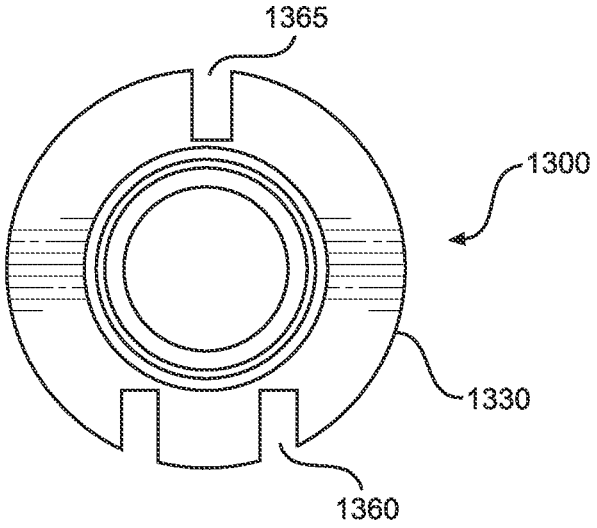
FIG. 8 shows a top elevation view of the tube of the lipstick extracting and application device.

Referring now to FIGS. 2, and 7-8, there is shown the exploded view of the lipstick extracting and application device, a perspective view of the tube and a top elevation view of the tube of the lipstick extracting and application device, respectively. A tube flange 1330 is disposed around an exterior perimeter of the tube 1300 between the upper and lower ends thereof. The tube flange 1330 comprises a pair of front slots 1360 and a rear slot 1365, wherein the front slots 1360 are positioned around the sidewall channel 1335 of the tube 1300. The front slots 1365 and the rear slot align with the respective front rails and rear rail of the housing. The tube flange 1330 abuts an interior shoulder 1170 of the housing 1100 to prevent vertical movement of the tube 1300 relative to the housing 1100.

The tube 1300 forms a channel 1310 having an open upper end 1315 configured to receive lipstick therein. In the illustrated embodiment, the channel 1310 comprises a circular cross section. A lower end 1320 of the channel 1310 is open and configured to receive the sliding barrel 1200 therein.

The sidewall channel of the tube 1300 is formed from a U-shaped brace 1380 extends downward from the tube flange 1330. The U-shaped brace 1380 is configured to abut the interior sidewall of the housing 1100 to add structural support in order to prevent movement of the tube relative to the housing. The brace 1380 comprises an open lower end to allow the neck of the sliding barrel and tab to move along a longitudinal axis of the tube 1300.

Figure 9:
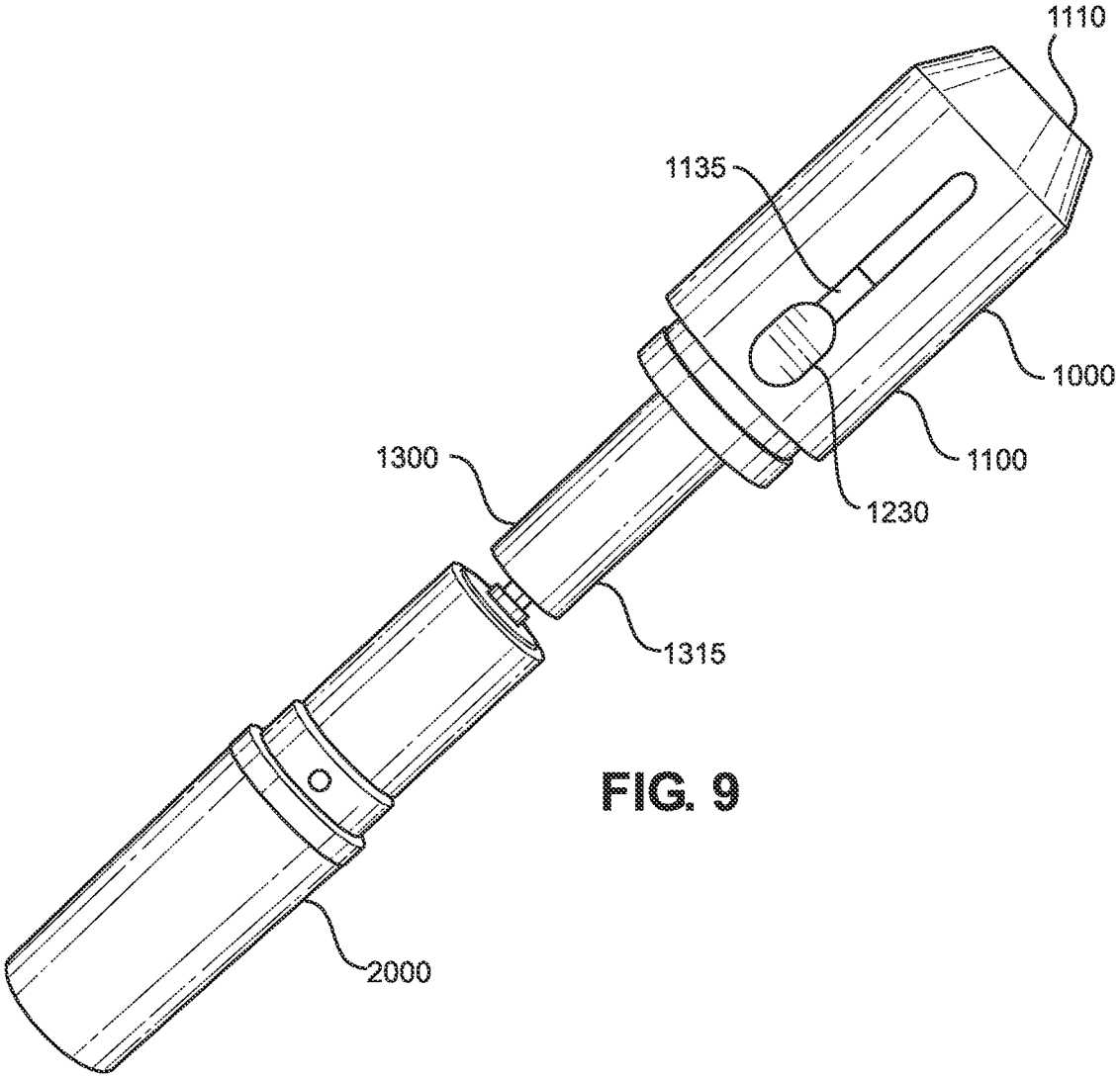
FIG. 9 shows a perspective view of an embodiment of the lipstick extracting and application device in the extended configuration and a lipstick holder.
Figure 10:
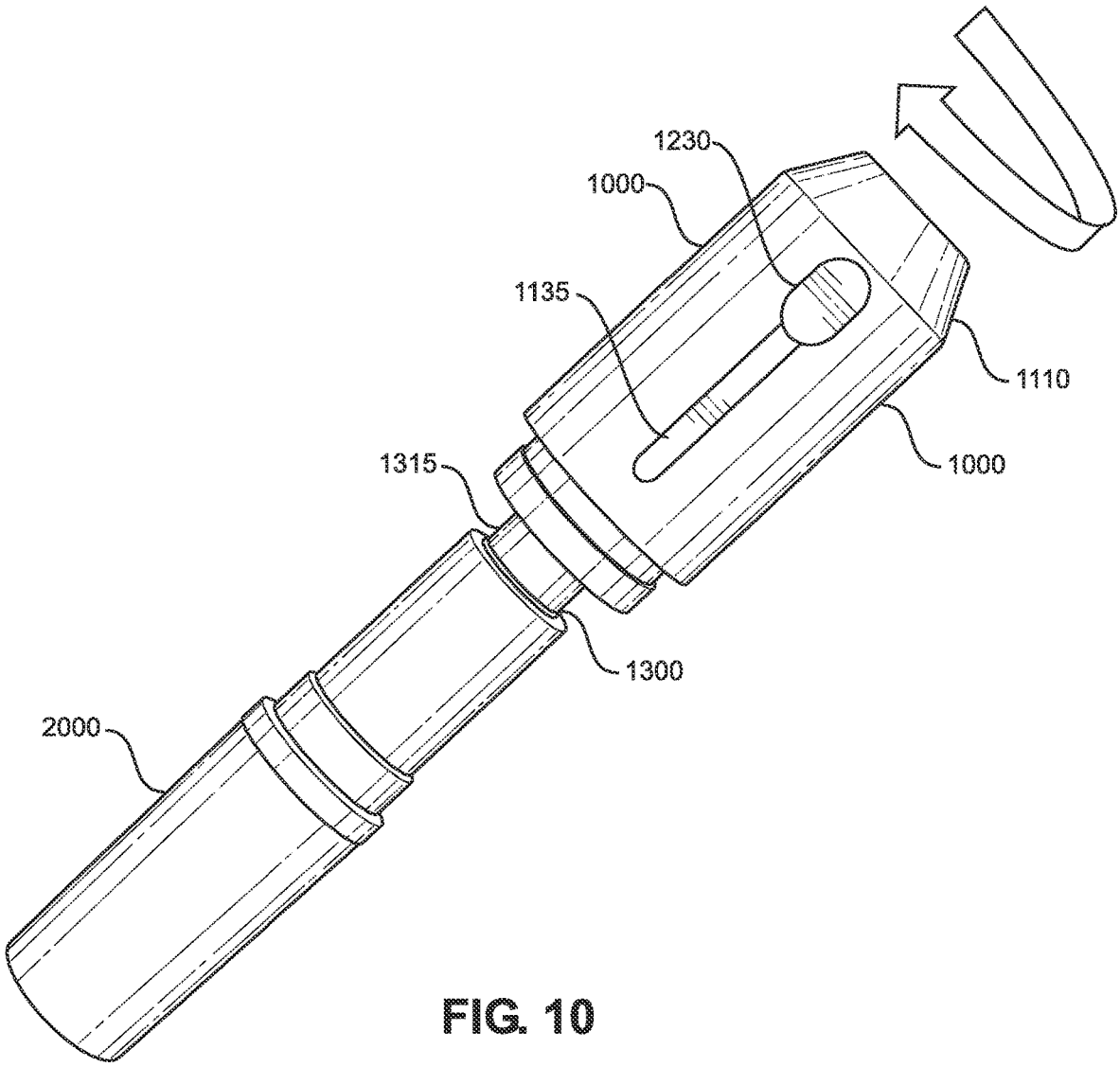
FIG. 10 shows a perspective view of an embodiment of the lipstick extracting and application device disposed within a lipstick holder, wherein the lipstick extracting and application device is in a retracted configuration.
Figure 11:
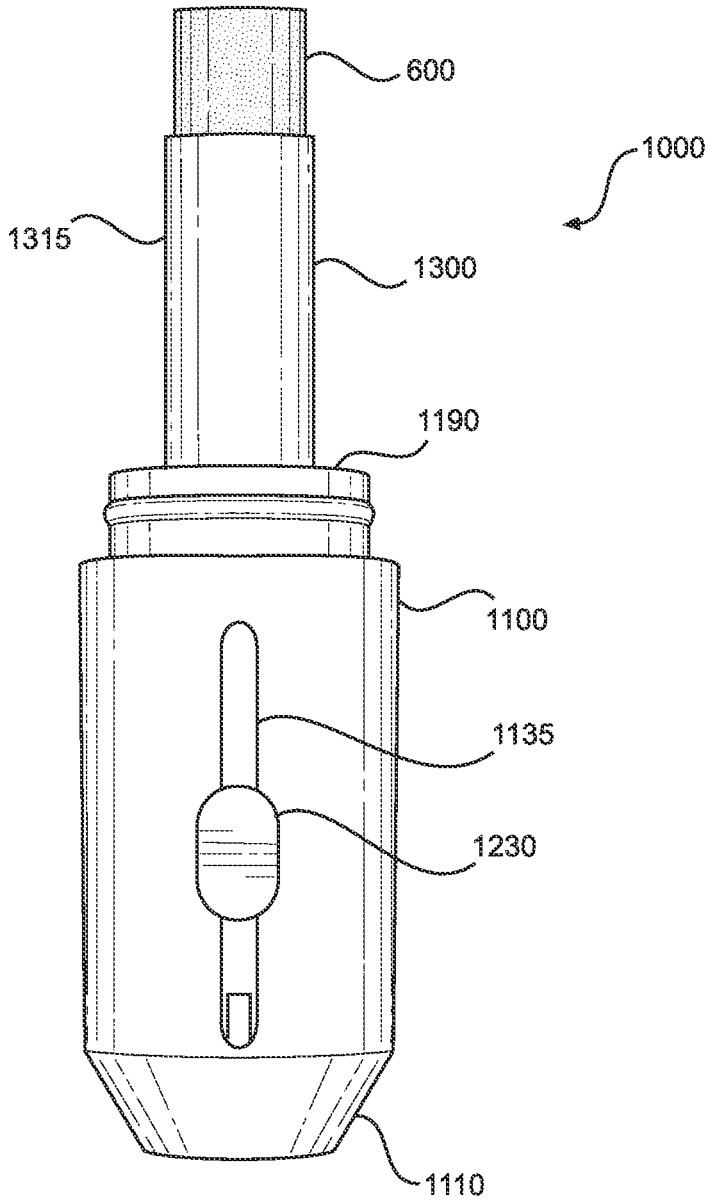
FIG. 11 shows a perspective view of an embodiment of the lipstick extracting and application device in an application use.

Referring now to FIGS. 9-11, there is shown a perspective view of an embodiment of the lipstick extracting and application device in the extended configuration, a lipstick holder and a perspective view of an embodiment of the lipstick extracting and application device disposed within a lipstick holder wherein the lipstick extracting and application device is in a retracted configuration, and a perspective view of an embodiment of the lipstick extracting and application device in an application use, respectively. The upper end 1315 of the tube 1300 comprises a circumference smaller than a circumference of the lipstick holder 2000, such that the upper end 1315 of tube 1300 can be circumscribed by the lipstick holder 2000 when the remaining lipstick 600 from the lipstick holder 2000 is to be extracted.

In operation, the upper end of the tube 1300 is pushed into the lipstick holder 2000 until the top of the tube 1300 reaches the bottom of the tube of the lipstick holder 2000 or the lipstick holder 2000 abuts the top side 1190 of the housing 1100. Once inserted, the sliding barrel 1200 is moved from the extended configuration to the retracted configuration, wherein the extended configuration the lipstick securing member of the sliding barrel 1200 is exterior to the opening of channel 1310 of the tube 1200. As the tube 1300 is pushed towards the lipstick holder 2000, any remaining lipstick 600 disposed in the holder is forced into the tube 1300. Once the tube 1300 reaches the bottom of the lipstick holder 2000, the sliding barrel 1200 is forcibly retracted due to the force applied against the remaining lipstick. The lipstick securing member disposed on the top side of the sliding barrel is inserted into the inaccessible portion of the lipstick within the holder and provides a hook to secure to the lipstick when the device is being removed from the lipstick holder 2000. Thus, when the tube 1300 is removed from within the lipstick holder, the lipstick extracting device 1000 extracts with it the contents of the lipstick which the tube and lipstick securing member have come in contact with.

In the illustrated embodiment, when the tube 1300 is fully inserted into the lipstick holder 2000, the tube 1300 is rotated about the lipstick holder such that any remaining lipstick breaks free from its lipstick holder. The housing 1100 is rotated about a longitudinal axis thereof while maintaining a fixed position of the lipstick holder 2000. The lipstick 600 is then housed within the lipstick extracting and application device.

In the illustrated embodiment, in the extended configuration, the tab 1230 is disposed toward the uppermost end of the sidewall channel 1135 of the housing. In the retracted configuration the sliding barrel 1200 is entirely disposed within the tube 1300, wherein the extended configuration the upper end or the lipstick securing member of the sliding barrel 1200 is exterior to the tube 1300 and housing 1100. In other embodiments, the separation of the lipstick from the lipstick holder occurs through a vacuuming action when the sliding barrel is pulled back along with the tube to suction the remaining portion of the lipstick from the holder in the lipstick tube. In alternate embodiments, the sliding barrel and tube are configured to separate the remaining lipstick from the lipstick holder in any suitable manner.

Once the lipstick 600 is removed from the lipstick holder 2000 and disposed within the housing 1100, the cap is fastened to the housing 1100. The sliding barrel 1200 is selectively moved via the tab 1230 between the extended configuration to access the extracted lipstick and the retracted configuration to store the extracted lipstick. It is contemplated that the lipstick extracting and application device comprise embodiments having other shaped housing and tube configurations. However, the tube configuration will always be sized to fit within a lipstick holder to access and extract unused and inaccessible lipstick that would otherwise be wasted, and the housing will be configured to store the extracted lipstick for direct application to a user's lips.

In one method of extracting lipstick from a lipstick holder, the method comprises providing a lipstick extracting device comprising a sliding barrel movably disposed within a tube, wherein the sliding barrel comprises a tab extending perpendicularly from a lower end thereof. A housing is formed around the sliding barrel and tube, wherein the housing comprises a base, an open upper end, and a sidewall extending therebetween. The sliding barrel is movable between an extended configuration and a retracted configuration, wherein the extended configuration the sliding barrel is moved away from the housing such that an upper end is positioned within the tube and in the retracted position the upper end of the sliding barrel is exterior the housing.

The method further comprises inserting the upper end of the tube into the lipstick holder with the sliding barrel in the retracted position, sliding the tab such that the sliding barrel is moved to the extended configuration, wherein the extended configuration an upper end of the sliding barrel is exterior to the upper end of the tube and engages a portion of lipstick within the lipstick holder, rotating the housing about a horizontal axis thereof while in the extended configuration and maintaining a fixed position of the lipstick holder to the sliding barrel, and extracting the portion of lipstick from the lipstick holder by transitioning the sliding barrel into the retracted position.

In one embodiment, the method further comprises positioning the sliding barrel into an applicator configuration after extracting the portion of lipstick, wherein the sliding barrel is positioned between the extracted and retracted configurations to expose the portion of lipstick for selective application.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lipstick extracting and application device, comprising:

a sliding barrel movably disposed within a tube, wherein the sliding barrel comprises a tab extending from a lower end thereof;

a housing formed around the sliding barrel and the tube, wherein the housing comprises a base, an open upper end, and a sidewall extending therebetween;

wherein the sliding barrel is movable between an extended configuration, a retracted configuration, and an applicator configuration;

wherein an upper end of the tube is sized to be received within a circumference of a lipstick holder when aligned along an axis concentric to the lipstick holder, such that the upper end of tube is adapted to be circumscribed by the lipstick holder;

wherein the sliding barrel is configured to remove a portion of lipstick within the lipstick holder when the sliding barrel is disposed within a tube of the lipstick holder;

wherein the applicator configuration the sliding barrel is positioned between the extracted and retracted configurations so as to expose the portion of lipstick for selective application.

2. The lipstick extracting and application device of claim 1, further comprising an exterior shoulder extending around a perimeter of the housing configured to receive and secure to a cap to removably cover the upper end of the tube.

3. The lipstick extracting and application device of claim 1, wherein the tab is disposed through a sidewall channel of the housing to allow a user to selectively move the sliding barrel between the extended configuration and the retracted configuration.

4. The lipstick extracting and application device of claim 3, wherein the tab is further disposed through a sidewall channel of the tube that is aligned with the sidewall channel of the housing, such that the housing, the tube, and the sliding barrel are cooperatively secured so as to only provide for relative movement of the sliding barrel between the extended and retracted configurations.

5. The lipstick extracting and application device of claim 1, wherein the sliding barrel further comprises an upper end having a lipstick securing member configured to remove the lipstick from the lipstick holder.

6. The lipstick extracting and application device of claim 1, wherein a first position the upper end of the tube is aligned along an axis concentric with the lipstick holder and seated therein, such that as the sliding barrel transitions from the retracted configuration to the extended configuration, the lipstick securing member penetrates the portion of lipstick housed within the lipstick holder; wherein once the lipstick securing member penetrates the portion of lipstick, the sliding barrel transitions to the retracted position to extract the portion lipstick from the lipstick holder; wherein a second position the sliding barrel is in the retracted position and coupled with the portion of lipstick.

7. The lipstick extracting and application device of claim 5, wherein the lipstick securing member is disposed at an uppermost surface of the sliding barrel.

8. The lipstick extracting and application device of claim 7, wherein the lipstick securing member comprises a planar disc elevated from the upper most surface by a support member, wherein the planar disc comprises a diameter smaller than a diameter of a sidewall of the sliding barrel.

9. The lipstick extracting and application device of claim 8, wherein the support member comprises an x-shaped cross section.

10. The lipstick extracting and application device of claim 1, wherein the lower end of the sliding barrel comprises a slot disposed along a horizontal plane, the slot configured to receive the base of the housing therein.

11. The lipstick extracting and application device of claim 1, wherein the base of the housing comprises a cradle extending inward configured to support a neck of the tab in the retracted configuration.

12. The lipstick extracting and application device of claim 1, wherein the tube comprises a flange extending around an outer perimeter that abuts an interior shoulder of the housing to prevent vertical movement of the tube relative to the housing.

13. The lipstick extracting and application device of claim 12, further comprising:

a pair of front slots and a rear slot disposed in the tube flange, wherein the front slots are positioned around a sidewall channel of the tube;

a pair of front rails and a rear rail disposed on an interior of the housing and secured within the respective front slots and the rear slot of the tube flange to prevent rotation movement of the tube relative to the housing.

14. The lipstick extracting and application device of claim 1, wherein the retracted configuration the sliding barrel is entirely disposed within the tube.

15. The lipstick extracting and application device of claim 1, wherein the extracting position the upper end of the sliding barrel is exterior to the tube and housing.

16. The lipstick extracting and application device of claim 1, wherein the portion of lipstick is extracted as the housing is rotated about a longitudinal axis as the sliding barrel is disposed within the lipstick holder.

17. A method of extracting lipstick from a lipstick holder, comprising:

providing a lipstick extracting device comprising:

a sliding barrel movably disposed within a tube, wherein the sliding barrel comprises a tab extending perpendicularly from a lower end thereof;

a housing formed around the sliding barrel and tube, wherein the housing comprises a base, an open upper end, and a sidewall extending therebetween;

wherein the sliding barrel is movable between an extended configuration and a retracted configuration;

inserting the upper end of the tube into the lipstick holder with the sliding barrel in the retracted position;

sliding the tab such that the sliding barrel is moved to the extended configuration, wherein the extended configuration an upper end of the sliding barrel is exterior to the upper end of the tube and engages a portion of lipstick within the lipstick holder;

rotating the housing about a horizontal axis thereof while in the extended configuration and maintaining a fixed position of the lipstick holder to the sliding barrel;

extracting the portion of lipstick from the lipstick holder by transitioning the the sliding barrel into the retracted position.

18. The method of claim 17, further comprising:

positioning the sliding barrel into an applicator configuration after extracting the portion of lipstick, wherein the sliding barrel is positioned between the extracted and retracted configurations to expose the portion of lipstick for selective application.

* * * * *